US009027671B2

(12) United States Patent
Koederitz

(10) Patent No.: US 9,027,671 B2
(45) Date of Patent: May 12, 2015

(54) APPARATUS AND METHOD FOR AUTOMATED DRILLING OF A BOREHOLE IN A SUBSURFACE FORMATION

(75) Inventor: William Leo Koederitz, Cedar Park, TX (US)

(73) Assignee: National Oilwell Varco, L.P., Houston, TX (US)

( * ) Notice: Subject to any disclaimer, the term of this patent is extended or adjusted under 35 U.S.C. 154(b) by 665 days.

(21) Appl. No.: 13/289,716

(22) Filed: Nov. 4, 2011

(65) Prior Publication Data

US 2012/0118636 A1 May 17, 2012

Related U.S. Application Data

(60) Provisional application No. 61/412,863, filed on Nov. 12, 2010.

(51) Int. Cl.
*E21B 44/00* (2006.01)

(52) U.S. Cl.
CPC ..... *E21B 44/00* (2013.01); *E21B 44/005* (2013.01)

(58) Field of Classification Search
CPC ..... E21B 44/00; E21B 44/005
USPC ..... 175/24, 26, 27
See application file for complete search history.

(56) References Cited

U.S. PATENT DOCUMENTS 5,842,149 A 11/1998 Harrell et al.
6,382,331 B1 * 5/2002 Pinckard ..... 175/27
6,662,110 B1 12/2003 Bargach et al.
6,785,641 B1 * 8/2004 Huang ..... 703/7
7,139,689 B2 * 11/2006 Huang ..... 703/7
8,256,532 B2 * 9/2012 Gray ..... 175/48
2003/0015351 A1 1/2003 Goldman et al.
2005/0096847 A1 * 5/2005 Huang ..... 702/9
2007/0067147 A1 * 3/2007 Huang ..... 703/7
2008/0156531 A1 7/2008 Boone et al.

(Continued)

FOREIGN PATENT DOCUMENTS

WO 01/79658 A1 10/2001
WO 2008/070829 A2 6/2008
WO 2009/135157 A2 11/2009

OTHER PUBLICATIONS

International Application No. PCT/US2011/059518, PCT International Search Report and Written Opinion dated Dec. 11, 2012 (14 pgs).

(Continued)

*Primary Examiner* — Nicole Coy
(74) *Attorney, Agent, or Firm* — Conley Rose, P.C.

(57) ABSTRACT

Apparatus and method for automated drilling of a borehole in a subsurface formation. In one embodiment, a method includes selecting at least one control variable. A drilling performance objective having a value that is influenced by drilling of the borehole using the at least one control variable is defined. A first interval of the borehole is drilled maintaining the at least one control variable at a first value. A second interval of the borehole is drilled maintaining the at least one control variable at a second value. A third interval of the borehole is drilled maintaining the at least one control variable at a third value. The third value is selected based on a comparison of the values of the drilling performance objective while drilling the first interval and second interval to a predetermined optimal value of the drilling performance objective.

21 Claims, 6 Drawing Sheets

(56) References Cited

U.S. PATENT DOCUMENTS

| | | | | |
|---|---|---|---|---|
| 2012/0118637 | A1* | 5/2012 | Wang et al. | 175/24 |
| 2012/0123756 | A1* | 5/2012 | Wang et al. | 703/2 |

OTHER PUBLICATIONS

Fertl, W.H., G.V. Chilingar, and J.O. Robertson Jr., Chapter 6 Drilling Parameters, Developments in Petroleum Science, vol. 50, 2002, pp. 151-167.

Koederitz, William L. and Jeff Weis, A Real-time Implementation of MSE, presented at the AADE 2005 National Technical Conference and Exhibition, held at the Wyndam Greenspoint in Houston, Texas, Apr. 5-7, 2005, AADE-05-NTCE-66.

Teale, R., The Concept of Specific Energy in Rock Drilling, Int. J. Rock Mech. Mining Sci. vol. 2, pp. 57-73, Pergamon Press 1965.

Thorogood, John, Aldred Walt, Fred Florence, and Fionn Iversen, Drilling Automation: Technologies, Terminology and Parallels with Other Industries, presented at SPE/IADC Drilling Conference and Exhibition held in Amsterdam, The Netherlands, Mar. 17-19, 2009, SPE/IADC 119884.

Young, Jr., F.S., Computerized drilling control, Journal of Petroleum Technology, vol. 21, No. 4, Apr. 1969, pp. 483-496.

European Patent Application No. 11784894.5 Examination Report dated Jun. 3, 2014 (5 pages).

Canadian Patent Application No. 2817515 Office Action dated Jul. 15, 2014 (2 pages).

* cited by examiner

APPARATUS AND METHOD FOR AUTOMATED DRILLING OF A BOREHOLE IN A SUBSURFACE FORMATION

CROSS-REFERENCE TO RELATED APPLICATION

The present application claims priority to U.S. Provisional Patent Application No. 61/412,863, filed on Nov. 12, 2010; which is hereby incorporated herein by reference.

BACKGROUND

There are various approaches available for optimizing drilling performance. However, many of these schemes, particularly those relying on calculation of gradients to locate an optimum set of control parameters, are unsuitable for wide application without prior knowledge of drilling conditions or are susceptible to errors inherent in drilling performance measurements. Further, existing methods can be confounded by changes, especially unrecognized changes, in formation or drilling conditions. A general issue with these schemes is that the more data points that are collected and used for analysis, the more vulnerable the optimization is to errors due to drilling performance measurement or changes in the formation or drilling conditions. These errors would lead to a false optimum set of control parameters and drilling underperformance. Thus, there is a need for a robust and efficient method of finding an optimum set of control parameters without previous knowledge of drilling conditions and subject to changes in formation and drilling conditions, including changes that are not explicitly recognized.

SUMMARY

Apparatus and method for automated drilling of a borehole in a subsurface formation. In one embodiment, a method includes selecting at least one control variable. A drilling performance objective having a value that is influenced by drilling of the borehole using the at least one control variable is defined. A first interval of the borehole is drilled maintaining the at least one control variable at a first value. A second interval of the borehole is drilled maintaining the at least one control variable at a second value. A third interval of the borehole is drilled maintaining the at least one control variable at a third value. The third value is selected based on a comparison of the value of the drilling performance objective while drilling the first interval and the value of the drilling performance objective while drilling the second interval to a predetermined optimal value of the drilling performance objective.

In another embodiment, an apparatus for automated drilling of a borehole in a subsurface formation includes a drill sting, sensors, and a drilling performance optimizer. The drill sting drills the borehole and is controlled by a set of control variables. The sensors measure a plurality of drilling variables during drilling of the borehole. The drilling performance optimizer is configured to evaluate, based on at least one of the drilling variables, a drilling performance objective having a value that is influenced by drilling of the borehole using the set of control variables. The drilling performance optimizer is also configured to select an operative set of values for the set of control variables based on the value of the drilling performance objective.

In a further embodiment, a computer-readable medium is encoded with computer-executable instructions for automated drilling of a borehole in a subsurface formation. When executed the computer-executable instructions cause a processor to control drilling of a first interval of the borehole using a set of control variables populated with a set of first values, and to determine a first value of a drilling performance objective corresponding to drilling of the first interval of the borehole. The instructions also cause the processor to control drilling of a second interval of the borehole using the set of control variables populated with a set of second values, and to determine a second value of the drilling performance objective corresponding to drilling of the second interval of the borehole. The instructions also cause the processor to control drilling of a third interval of the borehole using the set of control variables populated with a set of third values. The processor selects the third set of values based on a determination of which of the first and second values of the drilling performance objective is closest to a predetermined optimal value of the drilling performance objective.

It is to be understood that both the foregoing summary and the following detailed description are exemplary of the invention and are intended to provide an overview or framework for understanding the nature and character of embodiments of the invention claimed herein. The accompanying drawings are included to provide a further understanding of embodiments of the invention and are incorporated in and constitute a part of this specification.

BRIEF DESCRIPTION OF THE DRAWINGS

The following is a description of the figures in the accompanying drawings. The figures are not necessarily to scale, and certain features and certain views of the figures may be shown exaggerated in scale or in schematic form in the interest of clarity and conciseness.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections. The recitation "based on" is intended to mean "based at least in part on." Therefore, if X is based on Y, X may be based on Y and any number of additional factors.

DETAILED DESCRIPTION

The drawings and discussion herein are directed to various embodiments of the invention. The embodiments disclosed are not intended, and should not be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment. Additional features of the disclosed embodiments will be set forth below.

Figure 1A:
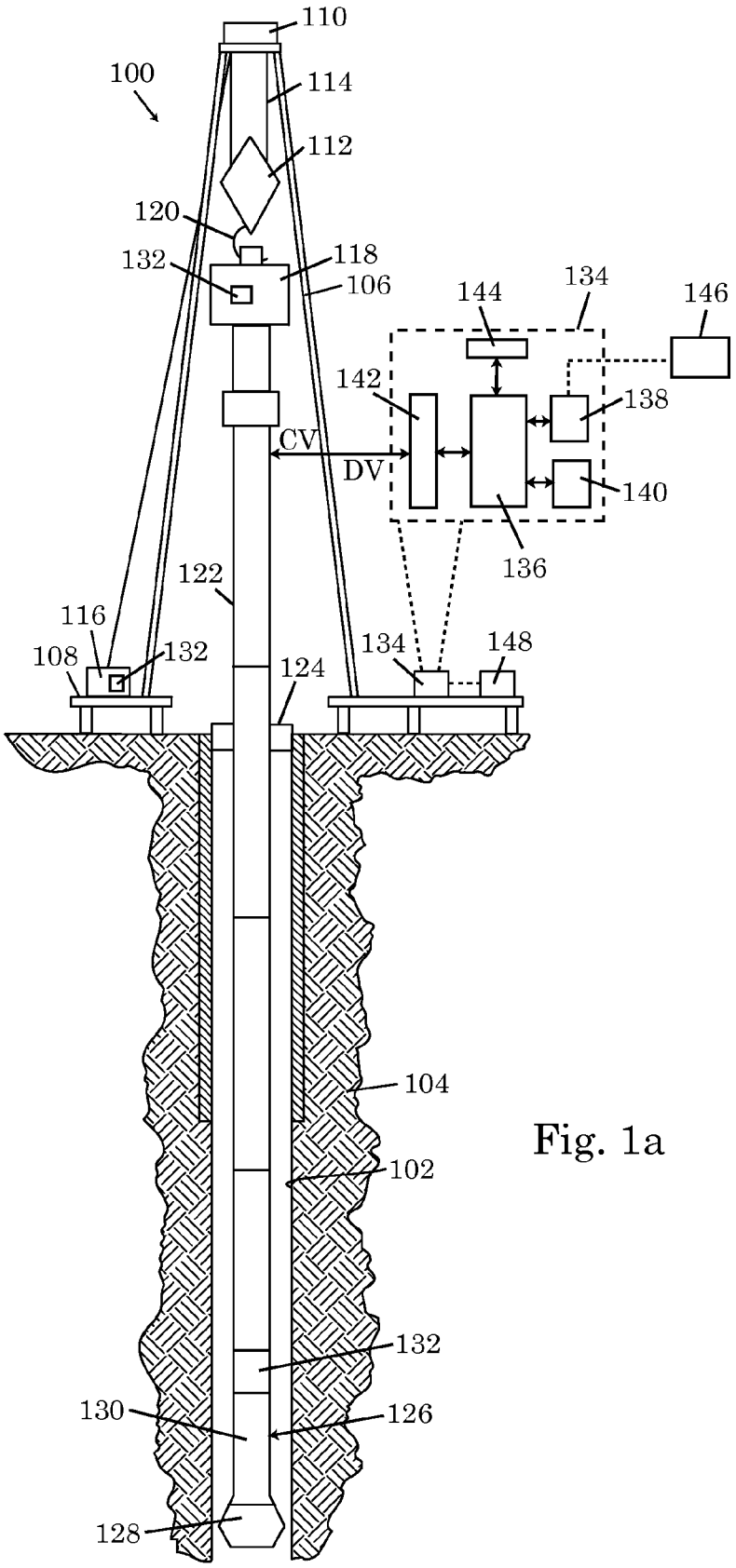
FIG. 1*a* is a schematic of an apparatus for automated drilling of a borehole in a subsurface formation.

In one embodiment, as illustrated in FIG. 1*a*, an apparatus 100 for automated drilling of a borehole 102 in a subsurface formation 104 includes a derrick 106 on a rig floor 108. A crown block 110 is mounted at the top of the derrick 106, and a traveling block 112 hangs from the crown block 110 by means of a cable or drilling line 114. One end of the cable or drilling line 114 is connected to drawworks 116, which is a reeling device operable to adjust the length of the cable or drilling line 114 so that the traveling block 112 moves up and down the derrick 106. A top drive 118 is supported on a hook 120 attached to the bottom of the traveling block 112. The top drive 118 is coupled to the top of a drill string 122, which extends through a wellhead 124 into the borehole 102 below the rig floor 108. The top drive 118 is used to rotate the drill string 122 inside the borehole 102 as the borehole 102 is being drilled in the subsurface formation 104. A bottomhole assembly 126 is provided at the bottom of the drill string 122. The bottomhole assembly 126 includes a bit 128 and a downhole motor 130 and may include other components not specifically identified but known in the art, e.g., a sensor package.

Although not shown, the automated drilling apparatus 100 includes a mud tank, which contains drilling fluid or "mud," a mud pump for transferring the drilling fluid to a mud hose, and a mud treatment system for cleaning the drilling fluid when it is laden with subsurface formation cuttings. The mud hose, in use, would be fluidly connected to the drill string so that the drilling fluid can be pumped from the mud tank into the drill string. The drilling fluid would be returned to the mud treatment system via a return path between the borehole and the drill string or inside the drill string, i.e., if the drill string is a dual-bore drill string. After the drilling fluid is cleaned in the mud treatment system, the clean drilling fluid would be returned to the mud tank. The details of the fluid circulation system are not shown in the drawing of FIG. 1*a* because these details are known in the art.

In one embodiment, the automated drilling apparatus 100 includes sensors (or instruments) 132 for measuring drilling variables. A variety of drilling variables may be measured by the sensors 132. The locations of the sensors in the automated drilling apparatus 100 and the types of sensors 132 will be determined by the drilling variables to be measured by the sensors 132. Examples of drilling variables that may be measured by the sensors 132 include, but are not limited to, weight on bit, bit or drill string rotational speed, drill string rotational torque, rate of penetration, bit diameter, and drilling fluid flow rate. The drilling variables may be measured directly or indirectly. In the indirect measurement, the desired drilling variable is derived from other measurable drilling variables. The drilling variables may be measured at the surface and/or in the borehole. For example, drill string rotational torque may be measured at the surface using a sensor 132 on the top drive 118. Alternatively, pressure differential across the downhole motor 130 may be measured using a sensor 132 downhole, and the drill string rotational torque may be derived from the pressure differential. In another example, the load on hook 120 may be measured using any suitable means at the surface, and weight on bit may be inferred from the hook load. Various other drilling variables not specifically mentioned above may be measured, or derived, as required by the drilling process.

In one embodiment, the automated drilling apparatus 100 includes one or more drilling controllers, such as drilling controller 134. In one embodiment, the drilling controller 134 includes a processor 136, memory 138, a display 140, a communications interface (or device(s)) 142, and an input interface (or device(s)) 144. The drilling controller 134 receives input from a user via the input interface 144. The drilling controller 134 communicates with components of the drilling apparatus 100 via the communications interface 142. The drilling controller 134 can send control set-points to the components of the drilling apparatus 100 via the communications interface 142. The drilling controller 134 can receive measurement of drilling variables from the various sensors 132 of the automated drilling apparatus 100 via the communications interface 142. Information related to operation of the drilling controller 134 may be presented on the display 140. The drilling controller logic may be loaded in the memory 138, or stored in some other computer-readable media 146 for subsequent loading into the memory 138. The processor 142 processes the drilling controller logic in memory 138 and interacts with the other components of the drilling controller 134.

The drilling controller 134 includes or is provided with a set of control variables. A set of control variables may have one or more control variables. Each control variable has a numerical value that indicates a control set-point for a component of the drilling apparatus 100. The components of the drilling apparatus 100 of interest are those that can be controlled via set-points. As previously mentioned, the drilling controller 134 sends the control set-points (i.e., numerical values of the control variables) to the appropriate drilling apparatus components via the communications interface 142. For example, the drilling controller 134 can send a control set-point to the top drive 118 that indicates an amount of drill string torsional torque to be outputted by the top drive 118. A feedback loop may be provided between the drilling apparatus components and the drilling controller 134 so that the drilling controller 134 can monitor variations in the outputs of the drilling apparatus components. For example, if a control set-point to the top drive 118 indicates that drill string torsional torque should be set at some value T, the top drive 118 may actually output anywhere from $T-\alpha$ to $T+\alpha$, where $\alpha$ is the variation in the output. The drilling controller 134 may collect information about such variations for later use. Although the drilling controller 134 is shown primarily at the surface in FIG. 1*a*, it should be noted that in other embodiments a portion or all of the drilling controller 134 may be located downhole. For example, drilling controller logic responsible for receiving and processing sensor data may be located downhole near where the sensor data is collected.

In an embodiment, the automated drilling apparatus 100 includes one or more drilling performance optimizers, such as drilling performance optimizer 148. In one embodiment, the drilling performance optimizer 148 includes logic for populating the set of control variables associated with the drilling controller 134 or the drilling process with a set of numerical values for the purpose of optimizing the drilling process according to a prescribed objective. How the drilling performance optimizer 148 works will be further described below in the context of a method for automated drilling of a borehole in a subsurface formation. The drilling performance optimizer logic may be stored on a computer-readable media. The drilling performance optimizer 148 may be separate from the drilling controller 134 or may be integrated with the drilling controller 134. Where the drilling performance optimizer 148 is separate from the drilling controller 134, it may include or be associated with a processor and memory for executing the drilling performance optimizer logic, a communications interface for communicating with the drilling controller 134, and an input interface for receiving input from a user. In other words, the drilling performance optimizer 148 may have a structure similar to that of the drilling controller 134, except for the underlying logic. Where the drilling performance optimizer 148 is integrated with the drilling controller 134, the drilling performance optimizer logic may reside in memory 138, or in some other computer-readable media 146 for subsequent loading into memory 138. In this case, the processor 136 would execute the drilling performance optimizer logic.

Figure 1B:
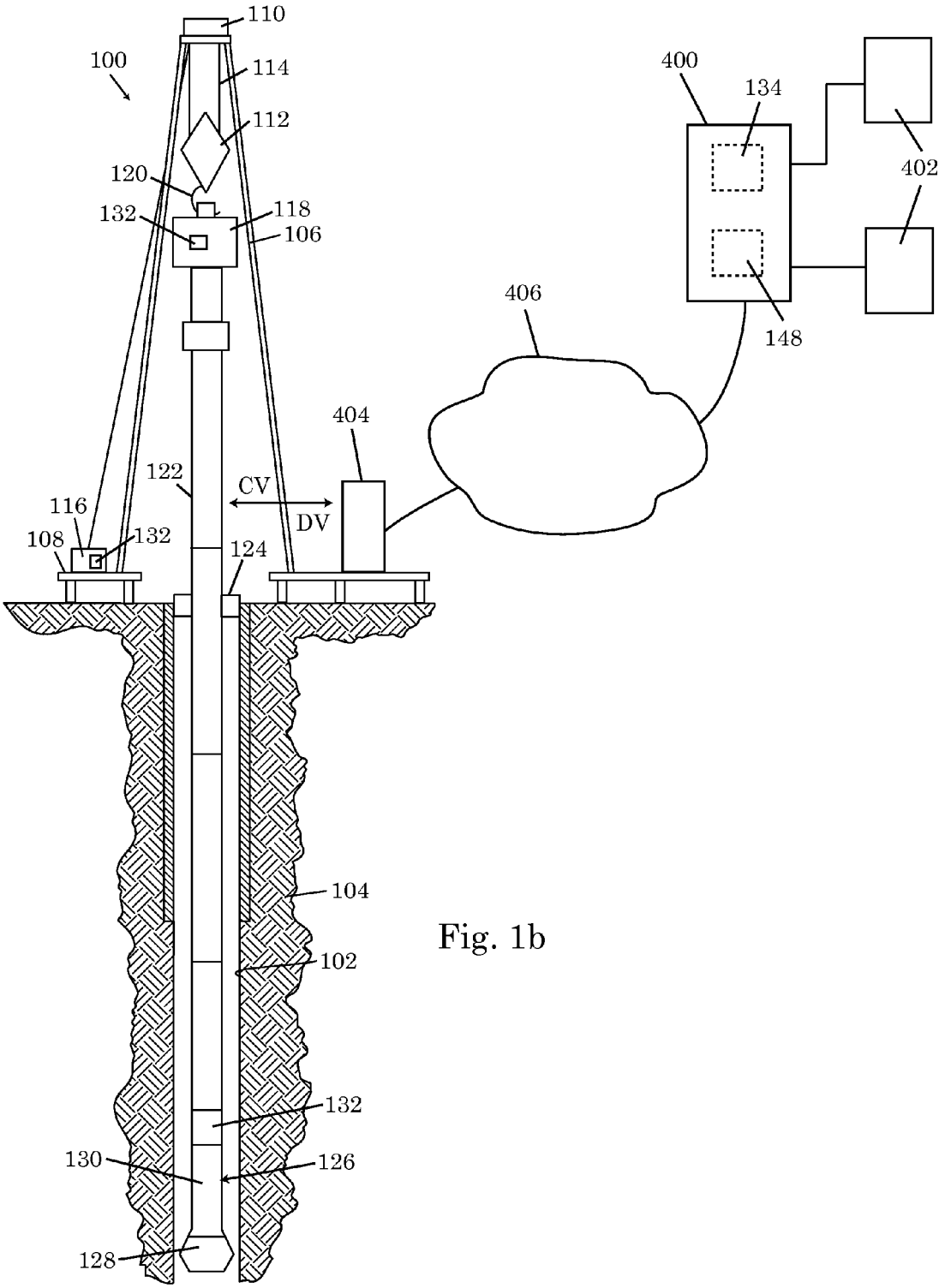
FIG. 1*b* is a schematic of an apparatus for automated drilling of a borehole in a subsurface formation, with a portion of the apparatus being remote from the drilling site.

In FIG. 1*a*, the drilling controller 134 and drilling performance optimizer 148 are shown at the drilling site. However, it is possible to have either or both of the drilling controller 134 and the drilling performance optimizer 148 at a location remote from the drilling site, with appropriate infrastructure provided to enable communication between the drilling controller 134 and desired components of the automated drilling apparatus 100. In one example, as illustrated in FIG. 1*b*, the logic of the drilling controller 134 and the logic of the drilling performance optimizer 148 are loaded onto a server 400 at a remote site. Analysts at the remote site can interact with the drilling controller 134 and drilling performance optimizer 148 via computers 402 connected, e.g., via a local area network or wide area network or world wide web, to the server 400. A client 404 can be provided at the drilling site. The client 404 can receive signals from components, e.g., sensors, of the automated drilling apparatus and can transmit signals to components, e.g., components requiring control set-points, of the automated drilling apparatus. The client 404 communicates with the server 400 over a network 406, e.g., the World Wide Web. Through the network 406, the logic of the drilling controller 134 can transmit control set-points to the client 404, which the client 404 will provide to components of the automated drilling apparatus 100. Also, through the network 406, the logic of the drilling controller 134 can receive measurement data from the client 404, which the client 404 will obtain from components of the automated drilling apparatus 100. In a modification of FIG. 1*b*, the drilling controller 134 may take the place of the client 404, with the logic of the drilling performance optimizer 148 still on the server 400. The drilling controller 134 could then communicate with the drilling performance optimizer 148 via the network 406. The logic of the drilling controller 134 and the drilling performance optimizer 148 may be provided as tangible products on computer-readable media. The logic on the computer-readable media, when executed, will perform automated drilling of a borehole, as will be described below.

Figure 2:
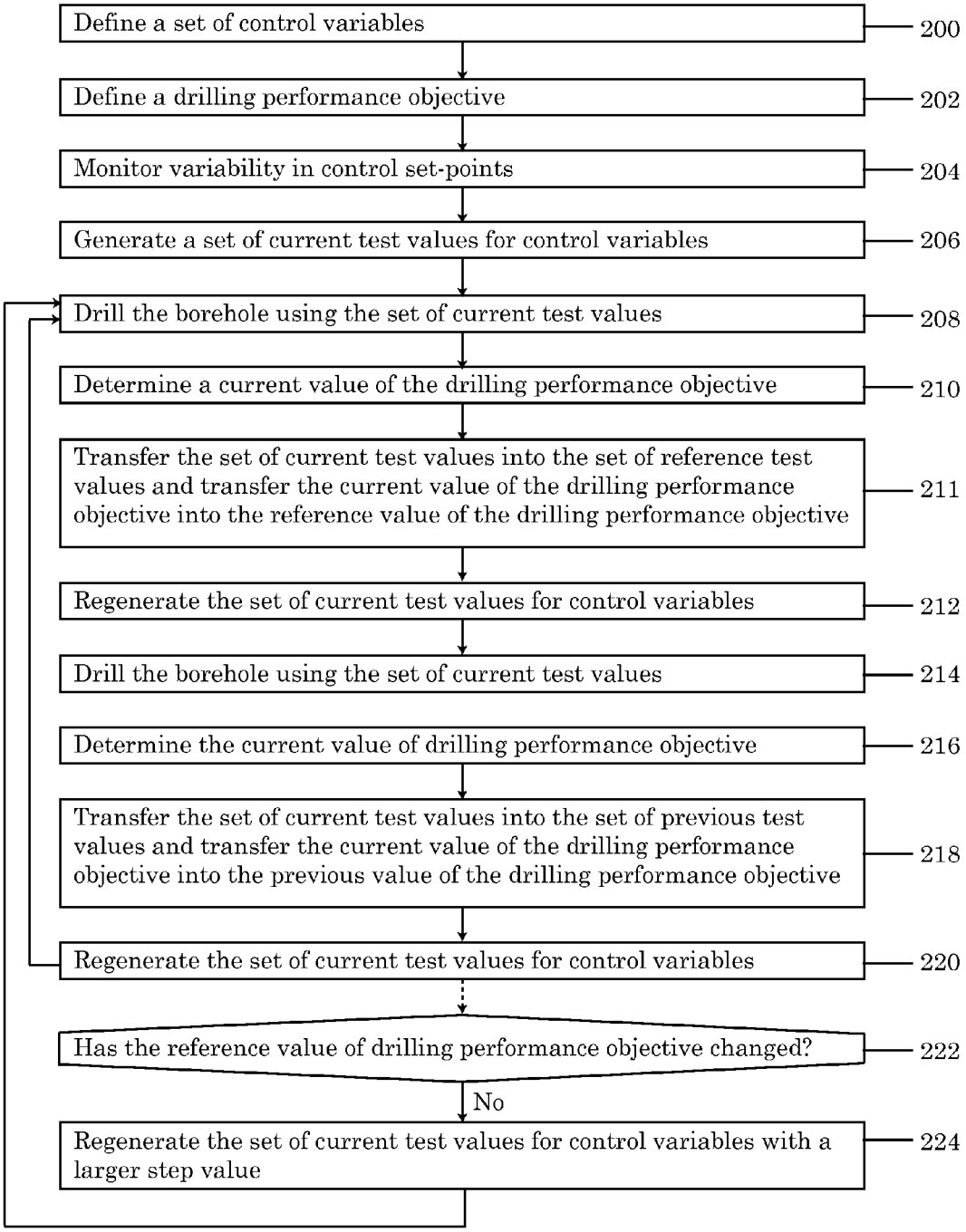
FIG. 2 is a flowchart illustrating a method for automated drilling of a borehole.

In one embodiment, as illustrated in FIG. 2, a APPARATUS AND METHOD FOR AUTOMATED DRILLING OF A BOREHOLE IN A SUBSURFACE FORMATION includes, at 200, defining a set of control variables. This set of control variables will be included in or associated with the drilling controller (134 in FIG. 1*a*). The set of control variables defined will depend on the drilling process, i.e., what drilling variables are to be controlled during the drilling process. Examples of control variables are weight on bit, bit rotational speed, drill string rotational torque, rate of penetration, and bit diameter. In general, the set of control variables CV may be expressed as $$CV=\{p_1,p_2,K,p_n\} \tag{1}$$

where $p_i$ represents a control variable. In a practical application, for example, a set of control variables could include bit rotational speed ($p_1$), weight on bit ($p_2$), drill string rotational torque ($p_3$), and rate of penetration ($p_4$). Prior to use in a drilling process, each control variable will be assigned a numerical value according to a scheme that will be described in more detail below. As previously noted, the numerical value will be a control set-point for a component of the automated drilling apparatus (100 in FIG. 1*a*).

The method includes, at 202, defining a drilling performance objective to be optimized during the drilling process. The drilling performance objective is defined in terms of one or more drilling variables. Examples of drilling variables include, but are not limited to, mechanical specific energy, rate of penetration, weight on bit, and bit rotational speed. In general, a drilling performance objective $F_j$ may be defined as $$F_j=f_j(P_1,P_2,K,P_n) \tag{2}$$

where $P_i$ represents a drilling variable to be optimized. Some practical examples of drilling performance objectives, which are not intended to limit the invention as otherwise described herein, follow.

In one practical example, a drilling performance objective, $F_1$, is defined as $$F_1=f_1(\mathrm{MSE}) \tag{3}$$

In one example, $$f_1(MSE) = MSE = E_m \times \left(\frac{4 \times WOB}{\pi \times D^2 \times 1000} + \frac{480 \times N_b \times T}{D^2 \times ROP \times 1000}\right) \tag{4}$$

where MSE psi is mechanical specific energy, $E_m$ is mechanical efficiency, WOB lb is weight on bit, D in is bit diameter, $N_b$ rpm is bit rotational speed, T ft-lb is drill string rotational torque, and ROP ft/hr is rate of penetration. (See, Koederitz, William L. and Weis, Jeff, "A Real-Time Implementation of MSE," presented at the AADE 2005 National Technical Conference and Exhibition, held at the Wyndam Greenspoint in Houston, Tex., Apr. 5-7, 2005, AADE-05-NTCE-66.) The numerical value of $F_1$ can be adjusted by adjusting the numerical value of any of the drilling variables in Equation (4). Typically, $E_m$ and D are fixed through at least a portion of a drilling process. WOB, $N_b$, T, and ROP on the other hand are adjustable at anytime during the drilling process by adjusting the numerical values of the control variables provided by the drilling controller to the drilling apparatus components. In this example, the drilling optimization problem can be expressed as minimizing $F_1$ subject to a set of constraints on the drilling variables.

In another practical example, a drilling performance objective, $f_2$, is defined as $$F_2=f_2(\mathrm{ROP}) \tag{5}$$

In one example, $$f_2(\mathrm{ROP})=\mathrm{ROP} \tag{6}$$

The value of $F_2$ can be adjusted by adjusting the numerical value of the variable in Equation (6), and the numerical value of the variable in Equation (6) can be adjusted by adjusting the numerical values of the control variables provided by the drilling controller to the drilling apparatus components. For example, ROP is affected by weight on bit and bit rotational speed. Adjustment of these variables will affect the value of ROP. In this example, the drilling optimization problem can be expressed as maximizing $F_2$ subject to a set of constraints on the drilling variables.

In another practical example, a drilling performance objective, $F_3$, is defined as $$F_3=f_{31}(\text{MSE})+f_{32}(\text{ROP}) \quad (7)$$

Specific forms of $f_{31}$(MSE) and $f_{32}$(ROP) are not given herein, but the forms of $f_{31}$(MSE) and $f_{32}$(ROP) will be different from the expressions given in Equations (4) and (6), respectively, since it is not possible to directly sum MSE and ROP and MSE and ROP are oppositely related. The value of $F_3$ can be adjusted by adjusting MSE and ROP, and MSE and ROP can be adjusted during a drilling process by adjusting the numerical values of the control variables provided by the drilling controller to the drilling apparatus components. In this example, the drilling performance optimization problem can be expressed as maximizing or minimizing $F_3$, depending on how $f_{31}$ and $f_{32}$ are defined, subject to constraints on the drilling variables. For example, it is possible to define $f_{31}$ and $f_{32}$ such that when $F_3$ is maximized, MSE is minimized and ROP is maximized.

The method includes, at 204, monitoring variability in control set-points. This involves providing a variety of control set-points to the components of the drilling apparatus and monitoring the outputs of the components to determine how able the system is to operate at the specified set-points. For the remainder of the description of the method illustrated in FIG. 2, three sets of test values are defined for the control variables: a set of current test values, a set of reference test values, and a set of previous test values. Also, three values of the drilling performance objective are defined: a current value corresponding to the set of current test values, a reference value corresponding to the set of reference values, and a previous value corresponding to the set of previous test values. These test and performance values will be generated during the automated drilling of the borehole. Initially, the method includes, at 206, generating the set of current test values for the control variables. Any suitable method may be used to generate the set of current test values. For example, a midpoint of the allowable range of values for each control variable may be selected as the current test value of the control variable. The drilling controller (134 in FIG. 1*a*) may generate the set of current test values, or the set of current test values may be generated externally, e.g., by a user or other entity, and supplied to the drilling controller.

The method includes, at 208, drilling an interval of the borehole in the subsurface formation using the set of control variables with the set of current test values. For this step, the drilling controller (134 in FIG. 1*a*) sends the set of current test values to the components of the drilling apparatus, and the components control the drilling process according to the set-points indicated in the set of current test values. During the drilling, at least the drilling variables that would allow calculation of the drilling performance objective defined at 202 are measured. During the drilling, additional data may be collected on set-point variability, as described at 204. The method includes, at 210, sampling the data measured during the drilling of 208 and using the sampled data to determine the current value of the drilling performance objective. In one embodiment, the drilling controller (134 in FIG. 1*a*) provides the necessary data to calculate the value of the drilling performance objective (as defined at 202) to the drilling performance optimizer (148 in FIG. 1*a*), and the drilling performance optimizer subsequently performs the calculation. It is also possible to manually calculate the value of the drilling performance objective, i.e., instead of the drilling performance optimizer performing the calculation. The method includes, at 211, transferring the set of current test values into the set of reference values and transferring the current value of the drilling performance objective into the reference value of the drilling performance.

Figure 3:
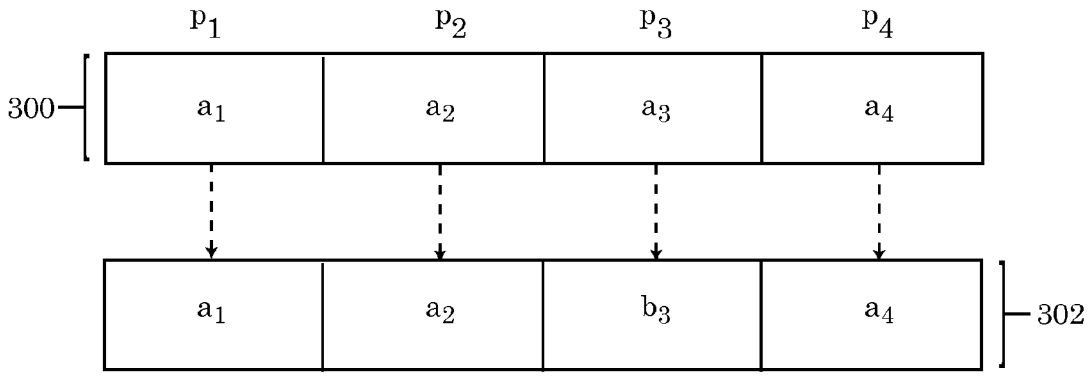
FIG. 3 is a graphical illustration of a set of reference test values and a set of current test values for a set of control variables.

The method includes, at 212, regenerating the set of current test values for the control variables so that the set of current test values is different from the set of reference test values. In one embodiment, the drilling performance optimizer (148 in FIG. 1*a*) automatically regenerates the set of current test values. In other embodiments, a user or other entity may regenerate the set of current test values. The set of current test values is created as an offset of the set of reference test values in a selected search direction. The search direction may be selected automatically by the drilling performance optimizer or may be supplied by a user or other entity. A simple illustration of a set of current test values that is created as an offset of a set of reference test values for a set of control variables CV={$p_1$, $p_2$, $p_3$, $p_4$} is shown in FIG. 3. In this figure, 300 represents a set of reference test values ($a_1$, $a_2$, $a_3$, $a_4$) for the control variables and 302 represents a set of current test values ($a_1$, $a_2$, $b_3$, $a_4$) for the control variables. In the particular example shown in FIG. 3, the reference and current test values for each of the control variables $p_1$, $p_2$, and $p_4$ are identical. However, the reference and current test values of the control variable $p_3$ are not identical. Therefore, the offset between the set of current test values and the set of reference values is achieved by modifying the value of control variable $p_3$. In general, the value of one or more control variables may be modified to generate an offset. In FIG. 3, the control variable $p_3$ has a reference test value of $a_3$ and a current test value of $b_3$, where $b_3$ is $a_3$ plus a step value $\delta$. Thus, the amount of offset is step value $\delta$. Below, it will be further illustrated that the offset is directional. The step value by which the value of a control variable is modified may be based on history of set-point variability and may be modified at each repeat of step 212. In general, the step value should be small, but not too small as to be negligible in the noise of the data. Step 212 may be referred to as a near search because it involves taking a small step away from the set of reference test values.

Figure 4:
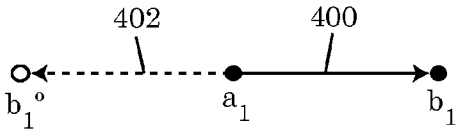
FIG. 4 is a graphical illustration of a one-dimensional offset between a set of current test values and a set of reference test values.
Figure 5:
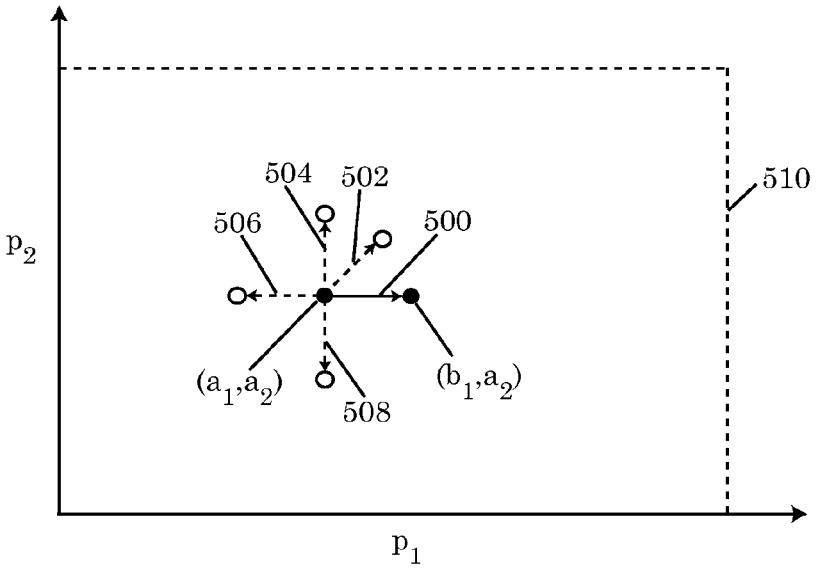
FIG. 5 is a graphical illustration of a two-dimensional offset between a set of current test values and a set of reference test values.
Figure 6:
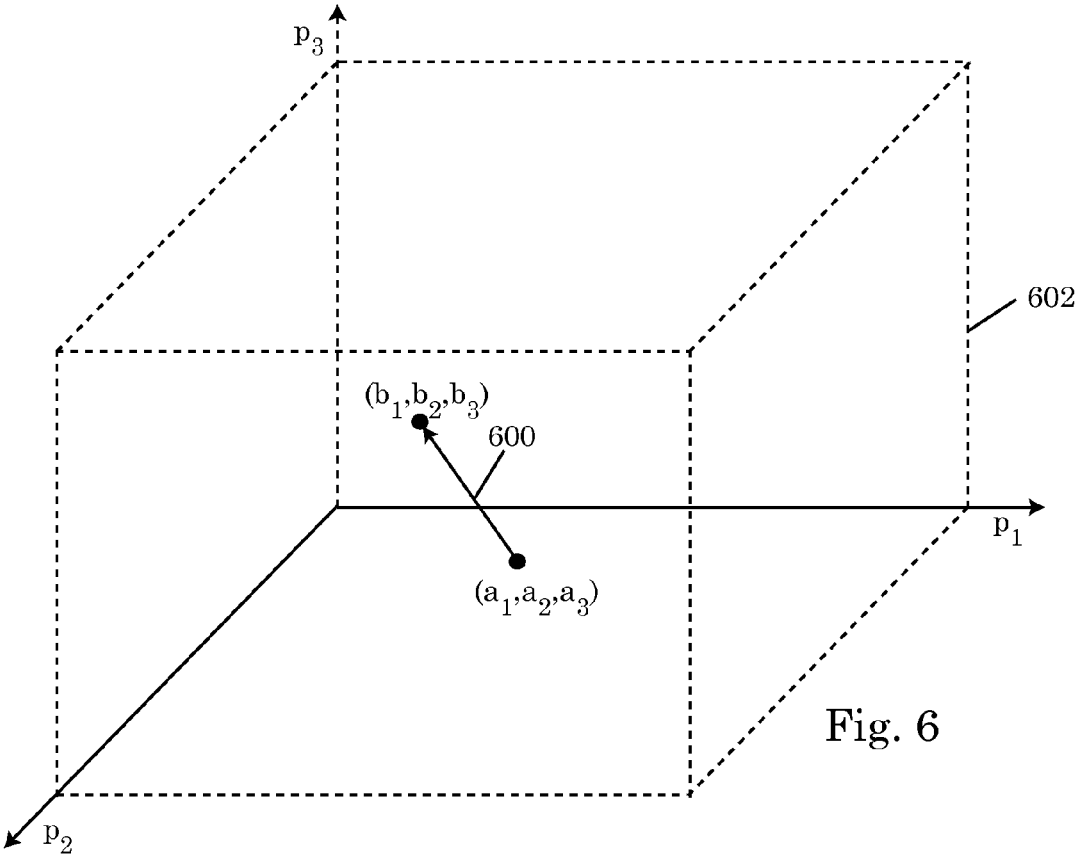
FIG. 6 is a graphical illustration of a three-dimensional offset between a set of current test values and a set of reference test values.

FIG. 4 illustrates offset between a set of current test values and a set of reference test values in one dimension. In FIG. 4, a control variable $p_1$ from a set of control variables, e.g., CV={$p_1$, $p_2$, . . . , $p_n$}, has a reference test value $a_1$. A step value $\delta$ is added to $a_1$ in a direction 400 to obtain a current test value $b_1$ for the control variable $p_1$. Alternatively, the step value $\delta$ could be added to $a_1$ in a direction 402 to obtain a current test value $b_1^o$ for the control variable $p_1$. FIG. 5 illustrates offset between a set of current test values and set of reference values in two dimensions. Two control variables $p_1$ and $p_2$ from a set of control variables, e.g., CV={$p_1$, $p_2$, . . . , $p_n$}, have the reference test values $a_1$ and $a_2$, respectively. The current test values of the control variables $p_1$ and $p_2$ are $b_1$ and $a_2$, respectively, where $b_1$ is $a_1$ plus step value $\delta$ along the direction 500. Along direction 500, there is no difference between the reference and current test values of $p_2$. Examples of alternate offset directions are indicated at 502, 504, 506, and 508. Along directions 502, 504, and 508, there will be a difference between the reference and current test values of $p_2$. The envelope 510 indicates the allowable search area. If a set of current values is created that is outside of the search area, the set of current values will be discarded and a new set of current values will be created. FIG. 6 illustrates offset between a set of current test values and a set of reference test values in three dimensions. In FIG. 6, control variables $p_1$, $p_2$, $p_3$ from a set of control variables, e.g., $CV=\{p_1, p_2, \ldots, p_n\}$, have reference test values $a_1$, $a_2$, $a_3$, respectively. The current test values of the control variables $p_1$, $p_2$, $p_3$ are $b_1$, $b_2$, and $b_3$, respectively. The distance between ($a_1$, $a_2$, $a_3$) and ($b_1$, $b_2$, $b_3$) along the direction 600 is step value δ. The envelope 602 indicates the allowable search area. As noted above, the search direction may be selected automatically by the drilling performance optimizer or may be supplied by a user or other entity. In the former case, the drilling performance optimizer may have access to a set of search directions from which it may make a selection or it may include logic to automatically generate a search direction.

The drilling performance optimizer (148 in FIG. 1*a*), or a user or other entity, provides the set of current test values generated at 212 to the drilling controller (134 in FIG. 1*a*), and the drilling controller in turn provides the set of current test values as control set-points to the components of the drilling apparatus. The method includes, at 214, drilling another test interval of the borehole using the set of control variables set to the set of current test values. During the drilling, at least the drilling variables that would allow calculation of the drilling performance objective are collected. During the drilling, additional data may be collected on variability of the outputs of the components relative to the control set-points. The method includes, at 216, sampling the data measured during the drilling of 214 and using the sampled data to determine the current value of the drilling performance objective. In one embodiment, the drilling controller provides the necessary data to calculate the current value of the drilling performance objective to the drilling performance optimizer (148 in FIG. 1*a*), and the drilling performance optimizer performs the calculation. The method includes, at 218, transferring the set of current test values into the set of previous test values and transferring the current value of the drilling performance objective to the previous value of the drilling performance objective.

Figure 7:
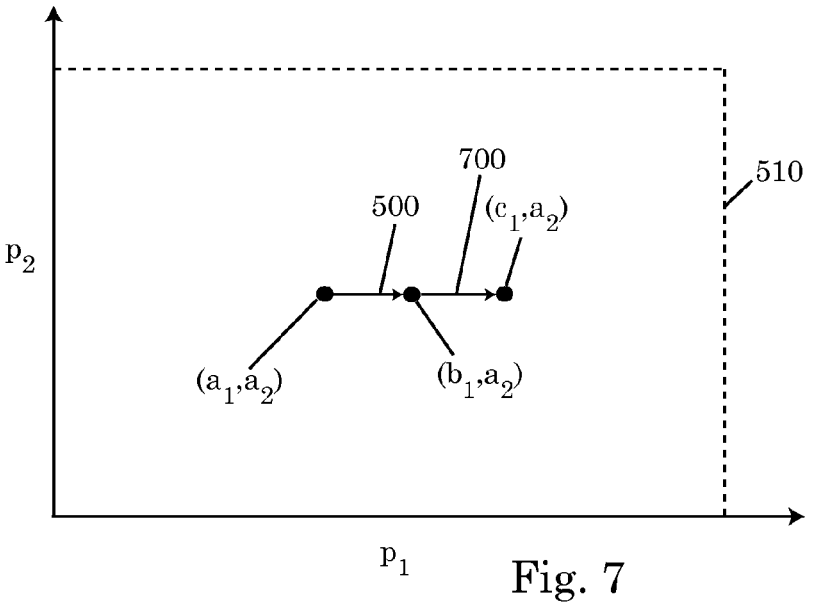
FIG. 7 is a graphical illustration of focused search in a previous direction.

The method includes, at 220, regenerating the set of current test values for the control variables so that the set of current test values is different from the set of previous test values at 218 and the set of reference test values at 211. The drilling performance optimizer (148 in FIG. 1*a*) can automatically regenerate the set of current test values as an offset of the set of previous test values or an offset of the set of reference test values, depending on how the previous value of the drilling performance objective compares to the reference value of the drilling performance objective. If the previous value of the drilling performance objective is preferred over, i.e., greater than in the context of a maximization problem or less than in the context of a minimization problem (closer to a predetermined optimum value (maximum or minimum) of the drilling performance objective), the reference value of the drilling performance objective, then the set of current test values will be created as an offset of the set of previous test values. This involves continuing the search along the previous direction used at 212. Searching along a previous direction is illustrated in FIG. 7 using the previous example of FIG. 5. In FIG. 7, the current test values of the control variables $p_1$ and $p_2$ are $c_1$ and $a_2$, respectively, where $c_1$ is $b_1$ plus step value δ along the search direction 700, which is the same as the previous search direction 500. Searching along a previous direction may be referred to as a focused search because it involves taking a small step in a previous search direction that has been found to yield a preferred result.

Figure 8:
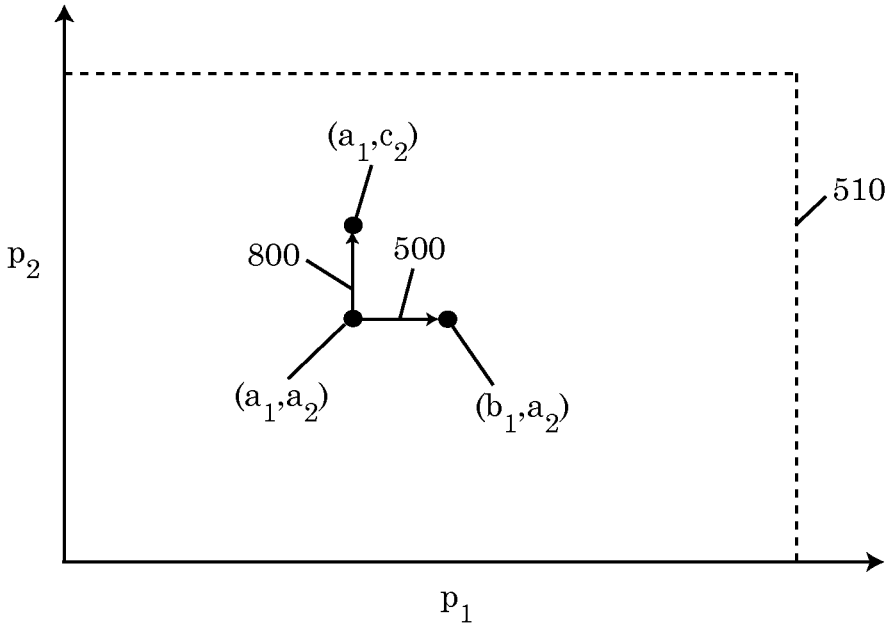
FIG. 8 is a graphical illustration of near search in a new direction.

However, if the reference value of the drilling performance objective is preferred over, i.e., greater than in the context of a maximization problem or less than in the context of a minimization problem, the previous value of the drilling performance objective, then search for the set of current test values will be taken along a different direction than previously used at 212. This is illustrated in FIG. 8 for the previous example of FIG. 5. In FIG. 8, the current test values of the control variables $p_1$ and $p_2$ are $a_1$ and $c_2$, respectively, where $c_2$ is $a_2$ plus step value δ along a new search direction 800. The new search direction 800 is relative to the set of reference test values. The previous search direction that did not yield a preferred result is shown at 500. The new search direction 800 is just an example. Other new search directions are possible, examples of which are illustrated in FIG. 5. Searching along a new search direction, such as new search direction 800 in FIG. 8, is also an example of a near search because it involves taking a small step away from the set of reference test values. As previously indicated, the new search direction may be automatically selected or generated by the drilling performance optimizer or a user or other entity may supply the new search direction.

The method includes returning to step 208 with the set of current test values generated at step 220 and repeating steps 208 to 220 a plurality of times. After repeating steps 208 to 220 a plurality of times, the method includes, at 222, checking whether the reference value of the drilling performance objective has changed over the plurality of times. If the reference value of the drilling performance objective has not changed, it may be a sign that the search is stuck. Some reasons why a search may become stuck will be discussed below. In the case of a stuck search, the method includes, at 224, regenerating the set of current values for the control variables using a larger step value than used during the repeat of steps 208 to 220. The larger step value may be a multiple of the smaller step value used during the repeat of steps 208 to 220, i.e., mδ, where m>1. The set of current values is regenerated as an offset of the set of reference values, as described in step 212, but with the larger step value. The direction of the offset may be the same as a previous direction or may be a new direction. The method includes repeating steps 208 to 220 a plurality of times using the set of current values generated at 224. The effect of using a larger step value in step 224 is to move the search to a different section of the search area. The search at step 224 may be referred to as a far search because it involves moving the search to a different section of the section area. Steps 208 to 224 can be repeated as many times as desired during a drilling process.

Table 1 below shows an example of a search sequence based on the drilling performance objective indicated in Equation (6) and a drilling optimization problem of maximizing ROP.

TABLE 1

| Search Type | Weight on Bit (lb) | Bit Rotational Speed (rpm) | Valid Test? | Average ROP (ft/hr) | Start Depth of Borehole (ft) | End Depth of Borehole (ft) |
|---|---|---|---|---|---|---|
| Near | 30 | 55 | Yes | 140.7 | 4603.1 | 4607.7 |
| Near | 31 | 60 | Yes | 154.6 | 4611.0 | 4616.2 |
| Focus | 32 | 60 | Yes | 156.7 | 4619.1 | 4624.4 |
| Focus | 33 | 60 | Yes | 141.8 | 4627.2 | 4631.9 |
| Focus | 33 | 55 | No[1] | 0.0 | 0.0 | 0.0 |

TABLE 1-continued

| Search Type | Weight on Bit (lb) | Bit Rotational Speed (rpm) | Valid Test? | Average ROP (ft/hr) | Start Depth of Borehole (ft) | End Depth of Borehole (ft) |
|---|---|---|---|---|---|---|
| Focus | 32 | 55 | Yes | 164.6 | 4638.1 | 4643.6 |
| Focus | 32 | 50 | No[2] | 0.0 | 0.0 | 0.0 |
| Focus | 33 | 50 | No[3] | 0.0 | 0.0 | 0.0 |

[1]Weight on bit is out of tolerance.
[2]Bit rotational speed is out of tolerance.
[3]Bit is off the bottom of the borehole.

The method described above can be used at the beginning of drilling of each new interval of the borehole to find the optimum set of values for the control variables for that interval. Or, the method can be used throughout the drilling of each new interval to keep the values of the control variables at the optimum for that entire interval. The method can be used with additional monitoring logic. For example, a monitoring process that detects excessive time spent at the same reference point could indicate a global change of formations or drilling conditions, possibly caused by suddenly entering a harder formation. Upon this detection, a "re-test" at the reference point could be triggered, as explained above, which would then recalibrate the search method and enable it to proceed away from the reference point. Another example is a diagnostic monitoring process watching for undesirable conditions, such as stick-slip. Such a detection could terminate the test and utilize the stick-slip detection as a consideration in the selection of the next set-point. Another example is a monitoring process watching for excessive surface torque. Such a detection could terminate the test and adjust the weight on bit and bit rotational speed for the next test based on a predetermined strategy for this event. The method could include detecting the severity of the excessive torque and using the detection to select between (1) conducting a test at the next set of parameters altered as per a predetermined plan and (2) stopping the drilling process, slowly lifting the drill pipe and unwinding the high-torque condition, resuming drilling, and then starting a new test at a new set of parameters that are different from those used at the time of the detection. Herein and above, a test refers to the process of adjusting drilling parameters (by adjusting the numerical values of control variables supplied by the drilling controller to the drilling apparatus) and measuring the response of the drilling process to the adjustment.

While a limited number of exemplary embodiments have been described, those skilled in the art, having benefit of this disclosure, will appreciate that other embodiments, not expressly described herein, are within the scope of the disclosed invention. Accordingly, the scope of the invention is limited only by the attached claims.

What is claimed:

1. A method for automated drilling of a borehole in a subsurface formation, comprising:

selecting at least one control variable;

defining a drilling performance objective having a value that is influenced by drilling of the borehole using the at least one control variable;

drilling a first interval of the borehole maintaining the at least one control variable at a first value;

drilling a second interval of the borehole maintaining the at least one control variable at a second value; and drilling a third interval of the borehole maintaining the at least one control variable at a third value, the third value being selected by applying an offset to one of the first value and the second value, a direction of the offset selected based on a comparison of the value of the drilling performance objective while drilling the first interval and the value of the drilling performance objective while drilling the second interval to a predetermined optimal value of the drilling performance objective;

selecting, for each of the first, second, and third interval, the value of the at least one control variable by applying a near search offset value to the value of the at least one control variable applied for a previously drilled interval;

determining whether the value of the drilling performance objective has changed over the first second and third intervals;

drilling a fourth interval of the borehole, and selecting, responsive to the determining, for the fourth interval of the borehole, a value of the at least one control variable by applying a far search offset value to the value of the at least one control variable based on the drilling performance objective not having changed over the first, second, and third intervals of the borehole;

wherein a magnitude of the far search offset value is greater than a magnitude of the near search offset value.

2. The method of claim 1, further comprising selecting the second value by applying an offset value to the first value.

3. The method of claim 1, further comprising selecting the third value by applying a first offset value to the second value based on the value of the drilling performance objective while drilling the second interval being nearer to the predetermined optimal value of the drilling performance objective than the value of the drilling performance objective while drilling the first interval is to the predetermined optimal value of the drilling performance objective.

4. The method of claim 3, further comprising selecting the third value by applying a second offset value to the first value based on the value of the drilling performance objective while drilling the first interval being nearer to the predetermined optimal value of the drilling performance objective than the value of the drilling performance objective while drilling the second interval is to the predetermined optimal value of the drilling performance objective.

5. The method of claim 4, wherein each of the first and second offset values comprises a magnitude and a direction, and the direction of the first offset value is different from the direction of the second offset value.

6. The method of claim 1, wherein the control variable comprises at least one of weight on bit, bit rotational speed, drill string rotational torque, rate of penetration and bit diameter.

7. The method of claim 1, wherein the drilling performance objective comprises at least one of mechanical specific energy of the drilling of the borehole and rate of penetration of drilling of the borehole.

8. An apparatus for automated drilling of a borehole in a subsurface formation, comprising:

a drill sting for drilling the borehole, the drill sting controlled by a set of control variables;

sensors for measuring a plurality of drilling variables during drilling of the borehole;

a drilling performance optimizer configured to:

evaluate, based on at least one of the drilling variables, a drilling performance objective having a value that is influenced by drilling of the borehole using the set of control variables; and select an operative set of values for the set of control variables by applying an offset to one of a first and second set of values of the control variables previously applied in drilling the borehole; and select a direction of the offset based on a comparison of values of a drilling performance objective produced by drilling with each of the first and second set of values to a predetermined optimal value of the drilling performance objective;

monitor the value of the drilling performance objective over drilling of more than three successive intervals of the borehole;

apply different sets of values for the set of control variables to each interval;

adjust each of the different sets of values by applying a near search offset;

determine whether the value of the drilling performance objective has changed over the more than three successive intervals; and generate a far search set of values for the set of control variables by applying a far search offset value based on the drilling performance objective not having changed over the more than three successive intervals of the borehole;

wherein a magnitude of the far search offset value is greater than a magnitude of the near search offset value.

9. The apparatus of claim 8, wherein the drilling performance optimizer is configured to:

compare to a predetermined optimum value of the drilling performance objective a first value of the drilling performance objective that is determined while drilling a first interval of the borehole using a first set of values of the set of control variables; and compare to the predetermined optimum value of the drilling performance objective a second value of the drilling performance objective that is determined while drilling a second interval of the borehole using a second set of values of the set of control variables; and select the operative set of values based on the comparisons.

10. The apparatus of claim 8, wherein the drilling performance optimizer is configured to select the operative set of values by applying an offset value to one of a first and second set of values for the set of control variables applied to drill intervals of the borehole; wherein the selection of one of the first and second set of values is based on the value of the drilling performance objective produced while applying each of the first and second set of values that is closest to a predetermined optimum value of the drilling performance objective.

11. The apparatus of claim 10, wherein the offset value comprises magnitude and direction; and the drilling performance optimizer is configured to select the direction of the offset value based on which of the first and second set of values for the set of control variables is applied to produce the value of the drilling performance objective closest to the predetermined optimum value of the drilling performance objective.

12. The apparatus of claim 11, wherein the drilling performance optimizer is configured to:

apply an offset having a same direction as that of a last applied offset based on the second set of values being applied to produce the value of the drilling performance objective closest to the predetermined optimum value of the drilling performance objective; and apply an offset having a different direction from that of a last applied offset based on the first set of values being applied to produce the value of the drilling performance objective closest to the predetermined optimum value of the drilling performance objective.

13. The apparatus of claim 11, wherein the drilling performance optimizer is configured to:

select the second set of values based on the first set of values; and apply the second set of values during a last drilling interval and apply the first set of values during a penultimate drilling interval.

14. The apparatus of claim 8, wherein the set of control variables comprise at least one of weight on bit, bit rotational speed, drill string rotational torque, rate of penetration and bit diameter; and the drilling performance objective comprises at least one of mechanical specific energy of the drilling of the borehole and rate of penetration of drilling of the borehole.

15. A non-transitory computer-readable medium encoded with computer-executable instructions for automated drilling of a borehole in a subsurface formation, when executed the computer-executable instructions cause a processor to:

control drilling of a first interval of the borehole using a set of control variables populated with a set of first values;

determine a first value of a drilling performance objective corresponding to drilling of the first interval of the borehole;

control drilling of a second interval of the borehole using the set of control variables populated with a set of second values;

determine a second value of the drilling performance objective corresponding to drilling of the second interval of the borehole; and control drilling of a third interval of the borehole using the set of control variables populated with a set of third values selected by applying an offset to one of the first set of values and the second set of values, a direction of the offset selected based on a determination of which of the first and second values of the drilling performance objective is closest to a predetermined optimal value of the drilling performance objective;

generate the values of the set of control variables applied while drilling each of the first, second and third intervals by applying a near search offset value to a previously used set of values, wherein the set of control variables is populated with a different set of values for each of the first, second, and third intervals;

determine whether the value of the drilling performance objective has changed over the first, second and third intervals;

generate a far search set of values for the set of control variables by applying a far search offset value to a previously used set of values based on the drilling performance objective not having changed over the first, second and third intervals of the borehole; and control drilling on a fourth interval of the borehole using the set of control variables populated with the far search set of values;

wherein a magnitude of the far search offset value is greater than a magnitude of the near search offset value.

16. The computer-readable medium of claim 15, encoded with instructions that cause a processor to generate the set of second values by applying an offset value to the set of first values.

17. The computer readable medium of claim 15, encoded with instructions that cause a processor to generate the set of third values by applying an offset value to one of the set of first values and the set of second values; wherein the offset value comprises a magnitude and a direction.

18. The computer readable medium of claim 17, encoded with instructions that cause a processor to select the one of the set of first values and the set of second values to which the offset is applied based on which of the first value of the drilling performance objective and the second value of the drilling performance objective is nearest to the predetermined optimal value of the drilling performance objective.

19. The computer readable medium of claim 18, encoded with instructions that cause a processor to:

apply an offset value comprising a first direction based on the set of first values being selected; and apply an offset value comprising a second direction based on the set of second values being selected.

20. The computer readable medium of claim 19, wherein the second direction is the same as a direction of an offset value applied to the set of first values to produce the set of second values.

21. The computer-readable medium of claim 15, encoded with instructions that cause a processor to:

select at least one control variable of the set of control variables from a group consisting of weight on bit, bit rotational speed, drill string rotational torque, rate of penetration and bit diameter; and select the drilling performance objective from a group consisting of mechanical specific energy of the drilling of the borehole and rate of penetration of drilling of the borehole.

* * * * *